US008125151B2

(12) United States Patent
Yamamoto et al.

(10) Patent No.: US 8,125,151 B2
(45) Date of Patent: Feb. 28, 2012

(54) HIGH-PRESSURE DISCHARGE LAMP, LIGHTING METHOD AND LIGHTING DEVICE FOR HIGH-PRESSURE DISCHARGE LAMP, HIGH-PRESSURE DISCHARGE LAMP DEVICE, AND LAMP UNIT, IMAGE DISPLAY DEVICE AND HEADLIGHT DEVICE

(75) Inventors: Masahiro Yamamoto, Takatsuki (JP); Syunsuke Ono, Takatsuki (JP); Minoru Ozasa, Kyoto (JP); Tsuyoshi Ichibakase, Takatsuki (JP); Tomoyuki Seki, Takatsuki (JP); Takashi Tsutatani, Otsu (JP); Haruo Nagai, Kyoto (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 12/142,681

(22) Filed: Jun. 19, 2008

(65) Prior Publication Data

US 2008/0258622 A1 Oct. 23, 2008

Related U.S. Application Data

(62) Division of application No. 10/552,257, filed as application No. PCT/JP2004/005144 on Apr. 9, 2004, now Pat. No. 8,076,852.

(30) Foreign Application Priority Data

Apr. 9, 2003 (JP) ..... 2003-105843

(51) Int. Cl.
*H01J 17/44* (2006.01)
*H01J 61/54* (2006.01)

(52) U.S. Cl. ..... 313/594; 313/602; 313/623; 313/607

(58) Field of Classification Search ..... 313/623, 313/607
See application file for complete search history.

(56) References Cited

U.S. PATENT DOCUMENTS

2001/0003411 A1* 6/2001 Honda et al. ..... 313/607
2004/0256991 A1 12/2004 Minamihata et al.

FOREIGN PATENT DOCUMENTS

| | | | |
|---|---|---|---|
| EP | 0 714 118 | A1 | 5/1996 |
| EP | 1 193 735 | A1 | 4/2002 |
| JP | 60-235349 | | 11/1985 |
| JP | 6-84504 | | 3/1994 |
| JP | 8-124530 | | 5/1996 |

(Continued)

OTHER PUBLICATIONS

Machine translation of JP 58198327.*

*Primary Examiner* — Joseph L Williams
*Assistant Examiner* — Zachary Snyder

(57) ABSTRACT

In a high-pressure discharge lamp that includes a bulb formed from a light emitting part having a discharge space therein and a pair of sealing parts connected to the light emitting part, and an electrode pair disposed within the discharge space, a section of a proximity conductor is wound substantially spirally around one of the sealing parts within a predetermined range from the light emitting part, while the remaining section of the proximity conductor crosses over the light emitting part and is electrically connected to the electrode nearer the other sealing part. By initiating a discharge after applying a high-frequency voltage of 1 kHz to 1 MHz to a high-pressure mercury lamp having this structure, the breakdown voltage can be suppressed to at least 8 kV.

14 Claims, 10 Drawing Sheets

FOREIGN PATENT DOCUMENTS

| | | |
|---|---|---|
| JP | 09-097591 | 4/1997 |
| JP | 2001-43831 | 2/2001 |
| JP | 2001-93677 | 4/2001 |
| JP | 2001-167737 | 6/2001 |
| JP | 2002-63992 | 2/2002 |
| JP | 03/083897 | 10/2003 |
| JP | 2003-297293 | 10/2003 |
| WO | 00/77826 | 12/2000 |

* cited by examiner

FIG.3

FREQUENCY OF HIGH FREQUENCY VOLTAGE vs. BREAKDOWN VOLTAGE

| FREQUENCY OF HIGH FREQUENCY VOLTAGE | 0.5kHz | 1.0kHz | 10kHz | 50kHz | 80kHz | 100kHz | 120kHz | 150kHz | 500kHz | ENCLOSED GAS PRESSURE |
|---|---|---|---|---|---|---|---|---|---|---|
| BREAKDOWN VOLTAGE | 12.0kV | 6.0kV | 6.0kV | 5.5kV | 5.0kV | 5.0kV | 5.0kV | 6.0kV | 6.0kV | 100mb |
| | 12.5kV | 7.5kV | 6.5kV | 6.0kV | 5.5kV | 5.5kV | 5.5kV | 7.0kV | 7.0kV | 200mb |
| | 13.0kV | 7.5kV | 7.0kV | 6.5kV | 6.0kV | 5.5kV | 6.0kV | 7.0kV | 7.0kV | 300mb |
| | 12.5kV | 8.0kV | 7.5kV | 7.0kV | 6.5kV | 6.0kV | 6.5kV | 7.5kV | 7.5kV | 400mb |

| FREQUENCY OF HIGH FREQUENCY VOLTAGE | 1.0MHz | 1.5MHz | 2.0MHz | 5.0MHz | ENCLOSED GAS PRESSURE |
|---|---|---|---|---|---|
| BREAKDOWN VOLTAGE | 7.5kV | 11.5kV | 12.5kV | 13.0kV | 100mb |
| | 7.5kV | 11.5kV | 12.5kV | 12.5kV | 200mb |
| | 7.5kV | 12.0kV | 12.5kV | 13.0kV | 300mb |
| | 8.0kV | 12.0kV | 13.0kV | 12.5kV | 400mb |

FIG.5

AMPLITUDE OF HIGH FREQUENCY VOLTAGE vs. BREAKDOWN VOLTAGE

| AMPLITUDE OF HIGH FREQUENCY VOLTAGE(p-p) | 200V | 400V | 1kV | 2kV | 4kV |
|---|---|---|---|---|---|
| BREAKDOWN VOLTAGE | 11.0kV | 8.0kV | 6.0kV | 5.5kV | 5.0kV |

HIGH-PRESSURE DISCHARGE LAMP, LIGHTING METHOD AND LIGHTING DEVICE FOR HIGH-PRESSURE DISCHARGE LAMP, HIGH-PRESSURE DISCHARGE LAMP DEVICE, AND LAMP UNIT, IMAGE DISPLAY DEVICE AND HEADLIGHT DEVICE

This is a divisional application of U.S. Ser. No. 10/552,257, filed on Oct. 5, 2005 now U.S. Pat. No. 8,076,852.

TECHNICAL FIELD

The present invention relates to a high-pressure discharge lamp, a lighting method and lighting device for a high-pressure discharge lamp, a high-pressure discharge lamp device, and a lamp unit, image display device and headlight device.

BACKGROUND ART

Generally, a high-voltage pulse of at least 20 kV must be applied between the electrodes in order to initiate a discharge in a high-pressure discharge lamp.

To generate this high-voltage pulse, a large transformer and high-voltage resistant electronic components must be used in the lighting device, adversely affecting lighting device miniaturization and cost savings. Also, noise occurring when the high-voltage pulse is generated causes operational errors and failure in the lighting device and surrounding electronic circuitry.

The prior art proposes decreasing the lamp breakdown voltage by mounting a proximity conductor to the outside of the bulb, as with the high-pressure mercury lamp described for example in Japanese Patent Application Publication No. 2001-43831, thereby decreasing the height of the high-voltage pulse generated by the lighting device.

FIG. 10 shows the structure of a high-pressure mercury lamp 500 according to conventional technology. As shown in the diagram, conventional high-pressure mercury lamp 500 includes a bulb 550 having a light emitting part 501, sealing parts 502 and 503 provided one at each end of light emitting part 501, and a wound portion 521 and a lead portion 522 of the proximity conductor, the light emitting part 501 having a pair of electrodes 504 and 505 disposed with a predetermined interval therebetween and a discharge space 512 formed therein.

Electrodes 504 and 505, which are electrically connected to external lead wires 508 and 509 via molybdenum foils 506 and 507 sealed respectively by sealing parts 502 and 503, are structured to receive power supply from an external source via molybdenum foils 506 and 507 and external lead wires 508 and 509.

Note that mercury and a rare gas are enclosed within light emitting part 501 at respective predetermined amounts.

Wound portion 521 of the proximity conductor is formed from a single-turn closed loop disposed so as to encircle a vicinity of the boundary between light emitting part 501 and sealing part 502. Wound portion 521 is electrically connected, via lead portion 522, to external lead wire 509 extending from the other end of sealing part 503.

With this structure, a 350 V DC voltage or an AC voltage of less than 50 Hz, for example, is firstly applied to electrodes 504 and 505 as a pre-discharge voltage, over which a high-voltage pulse considerably higher than the pre-discharge voltage is applied to initiate the discharge.

With this high-pressure mercury lamp according to conventional technology, electric fields are generated between electrode 504 and electrode 505, wound portion 521, and lead portion 522, respectively, due to the application of the high-voltage pulse between electrodes 504 and 505, resulting in a strong electric field concentrating in a vicinity of electrode 504. This concentrated electric field enables the discharge to be initiated with a relatively low high-voltage pulse.

However, even with this method disclosed in Japanese Patent Application Publication No. 2001-43831, a fairly large transformer and high-voltage resistant electronic components are required as before, meaning that the above demands for lighting device miniaturization and cost savings are not met. Also, the noise that occurs when generating the high-voltage pulse is not greatly decreased.

The present invention, devised in view of the above problems, aims to provide a high-pressure discharge lamp, a lighting method and lighting device for a high-pressure discharge lamp, a high-pressure discharge lamp device, and a lamp unit, image display device and headlight device that sufficiently decrease the height of a high-voltage pulse generated by a lighting device to allow for lighting device miniaturization, cost savings and noise reduction.

DISCLOSURE OF THE INVENTION

A high-pressure discharge lamp pertaining to the present invention for achieving the above object has: a bulb that includes a light emitting part having an electrode pair disposed and a discharge space formed therein, and a first sealing part and a second sealing part provided at different ends of the light emitting part; and a proximity conductor formed from a lead wire, a section of the lead wire being wound around an outer circumference of at least one of the first sealing part and a section of the light emitting part to form a wound portion, and a remaining section of the lead wire forming a lead portion that extends from the wound portion across the light emitting part in proximity to or contacting with an outer surface of the light emitting part, to a side of the discharge lamp on which the second sealing part is disposed. The lead portion is electrically connected to the electrode, of the pair, positioned nearer the second sealing part. Also, at least a section of the wound portion is wound substantially spirally at least 0.5 turns in a range from a $2^{nd}$ reference plane to a $3^{rd}$ reference plane, and a closed loop around one of the light emitting part and the first sealing part does not exist within the range, where the $2^{nd}$ to $3^{rd}$ reference planes are parallel to a $1^{st}$ reference plane lying orthogonal to a bulb longitudinal direction and including an end of the discharge space positioned at a base portion of the electrode nearer the first sealing part, the $2^{nd}$ reference plane being distant 5 mm from the $1^{st}$ reference plane along the first sealing part and the $3^{rd}$ reference plane passing through a tip of the electrode nearer the second sealing part.

Also, a high-pressure discharge lamp pertaining to the present invention has: a bulb that includes a light emitting part having an electrode pair disposed and a discharge space formed therein, and a first sealing part and a second sealing part provided at different ends of the light emitting part; and a proximity conductor formed from a lead wire, a section of the lead wire being wound around an outer circumference of at least one of the first sealing part and a section of the light emitting part to form a wound portion, and a remaining section of the lead wire forming a lead portion that extends from the wound portion across the light emitting part in proximity to or contacting with an outer surface of the light emitting part, to a side of the discharge lamp on which the second sealing part is disposed. The lead portion is electrically connected to the electrode, of the pair, positioned nearer the second sealing part. Also, the wound portion is without a closed loop and has at least a section wound substantially spirally at least 0.5 turns in a range from a $2^{nd}$ reference plane to a $3^{rd}$ reference plane that are parallel to a $1^{st}$ reference plane lying orthogonal to a bulb longitudinal direction and including an end of the discharge space positioned at a base portion of the electrode nearer the first sealing part, the $2^{nd}$ reference plane being distant 5 mm from the $1^{st}$ reference plane along the first sealing part, and the $3^{rd}$ reference plane passing through a tip of the electrode nearer the second sealing part.

The high-voltage pulse can be suppressed to a low value according to high-pressure discharge lamps having the above structures. As a result, the transformer installed in the lighting device can be reduced in size, and the voltage resistance of other electronic components can be lowered, making possible reductions in size, weight and cost. Also, noise that used to occur when generating the high-voltage pulse is decreased, allowing for the elimination of operational errors in surrounding electronic circuitry caused by this noise.

Note that the "end of the discharge space positioned at a base portion of the electrodes" referred to in the present invention indicates the section of the inner surface of the light emitting part at the base portion of the electrodes having the greatest curvature.

Also, a "high-frequency voltage" in terms of the present invention refers not only to the case in which the fundamental of the AC voltage is a high frequency, but also to a voltage whose harmonic component is a high frequency of at least a predetermined frequency even if the fundamental does not reach the predetermined frequency.

Here, a shortest distance from the lead portion to the inner surface of the light emitting part preferably is 10 mm or less in a range defined by the $1^{st}$ reference plane and a $4^{th}$ reference plane parallel to the $1^{st}$ reference plane and including an end of the discharge space positioned at a base portion of the electrode nearer the second sealing part.

Also, in a range defined by the $2^{nd}$ and $3^{rd}$ reference planes, a pitch interval of the substantially spirally wound portion of the proximity conductor preferably is at least 1.5 mm.

Note that this pitch interval is assumed to be the distance from an arbitrary position on the proximity conductor to a position one rotation (360° or 1 turn) removed from the arbitrary position.

Also, the present invention is a lighting method for a high-pressure discharge lamp, according to which a discharge of the high-pressure discharge lamp is initiated after applying a high-frequency voltage to the electrode pair.

This enables a high-frequency electric field to be generated within the discharge space of a high-pressure discharge lamp having the above structure, allowing for an increase in initial electrons within the discharge space and thus for effective lighting at a considerably reduced high-voltage pulse.

Here, a frequency of the high-frequency voltage preferably is in a range of 1 kHz to 1 MHz.

Also, an amplitude of the high frequency voltage preferably is at least 400 V.

The present invention is also a lighting device for lighting the high-pressure discharge lamp that includes a voltage applying unit operable to apply a high-frequency voltage to the electrode pair.

This enables a device to be provided that realizes an effective lighting method for the above high-pressure discharge lamp.

Here, a frequency of the high-frequency voltage preferably is in a range of 1 kHz to 1 MHz.

Also, an amplitude of the high frequency voltage preferably is at least 400 V.

Also, a high-pressure discharge lamp device pertaining to the present invention includes the high-pressure discharge lamp and the lighting device for lighting the high-pressure discharge lamp.

Furthermore, a lamp unit pertaining to the present invention has the high-pressure discharge lamp incorporated within a concave reflective mirror.

Also, an image display device pertaining to the present invention uses the high-pressure discharge lamp device.

Furthermore, a headlight device pertaining to the present invention uses the high-pressure discharge lamp device.

BRIEF DESCRIPTION OF THE DRAWINGS

FIG. 3 shows the relation between a breakdown voltage and the frequency of a high-frequency voltage;

FIG. 5 is a table showing the relation between a breakdown voltage and the amplitude of a high-frequency voltage;

BEST MODE FOR CARRYING OUT THE INVENTION

A high-pressure discharge lamp, lighting device and the like pertaining to a preferred embodiment of the present invention are described below taking a high-pressure mercury lamp as an example.

(1) Structure of High-Pressure Mercury Lamp 100

Figure 1:
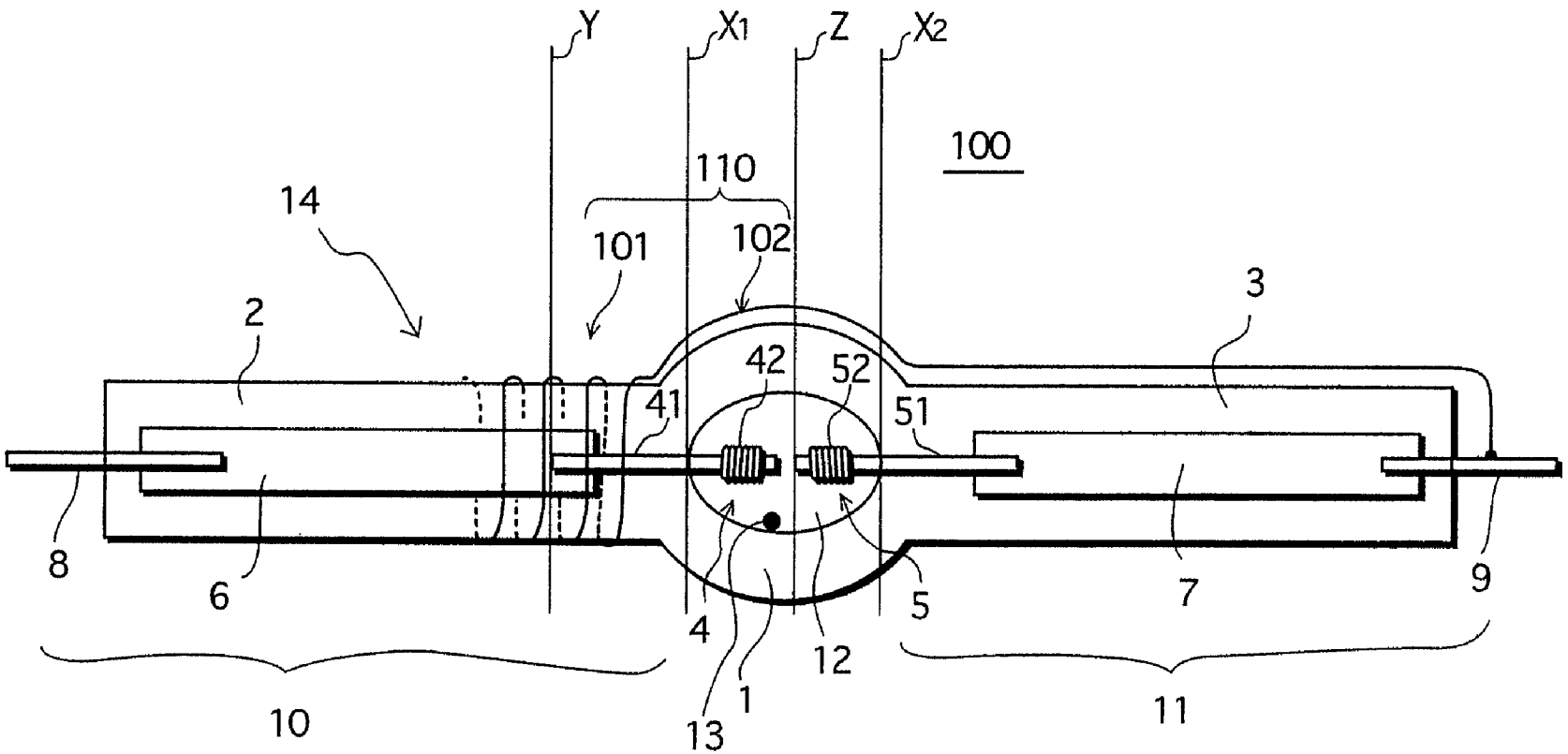
FIG. 1 shows the structure of a high-pressure mercury lamp pertaining to a preferred embodiment of the present invention.

FIG. 1 shows the structure of a high-pressure mercury lamp 100 pertaining to a preferred embodiment of the present invention.

As shown in the diagram, high-pressure mercury lamp 100 includes a substantially spherical or spheroid light emitting part 1 having a discharge space 12 formed therein, a quartz glass bulb 14 having a first sealing part 2 and a second sealing part 3 provided at different ends of light emitting part 1, electrode structures 10 and 11 in which electrodes 4 and 5, molybdenum foils 6 and 7 and external leads 8 and 9 are respectively connected in order, and a proximity conductor 110 that is wound around the outside of first sealing part 2 and extends across light emitting part 1 in proximity to or contacting with the outer surface thereof to the side of lamp 100 on which second sealing part 3 is disposed, where it is electrically connected to external lead 9 and thus electrode 5.

Electrodes 4 and 5 are made of tungsten, with electrode coils 42 and 52 being fixed respectively to the tips of electrode axes 41 and 51. Electrodes 4 and 5 are mounted so as to roughly oppose one another within light emitting part 1.

External leads 8 and 9 are made of molybdenum and lead out externally from the ends of sealing parts 2 and 3.

Light emitting part 1 is filled with mercury 13 as an arc material, a rare gas such as argon, krypton and xenon to assist the discharge, and a halogen material such as iodine and bromine.

The halogen material is inserted in order to inhibit the blackening of the inside of light emitting part 1 by means of the so-called halogen cycle according to which tungsten evaporated from electrodes 4 and 5 is returned to the electrodes without adhering to the inside of light emitting part 1.

Mercury 13 is enclosed at 150 mg/cm$^3$ to 350 mg/cm$^3$ (e.g. 200 mg/cm$^3$) of the internal volume capacity of light emitting part 1, and the pressure of the enclosed rare gas when the lamp has been cooled is set in a range of 100 mb to 400 mb.

Note that when the numerical range in the present invention is prescribed as "a to b", this indicates a range including the lower limit a and the upper limit b.

Proximity conductor 110 is a lead wire formed from an iron chromium alloy, and includes a coil-shaped portion (wound portion) 101 wound around first sealing part 2 and a lead portion 102 that extends across light emitting part 1 in proximity to or contacting with the outer surface thereof to the side of lamp 100 on which second sealing part 3 is disposed, where it is electrically connected to external lead wire 9.

As shown in FIG. 1, when a plane orthogonal to a longitudinal direction (tube axis direction) of bulb 14 and including an end of discharge space 12 positioned at the base portion of electrode 4 nearer the first sealing part is assumed to be a reference plane $X_1$ (1$^{st}$ reference plane), a plane parallel with and distant 5 mm from reference plane $X_1$ along first sealing part 2 is assumed to be a reference plane Y (2$^{nd}$ reference plane), and a plane parallel with reference plane $X_1$ and passing through the tip of electrode 5 (5 mm from reference plane $X_1$ in the present embodiment) nearer the second sealing part is assumed to be a reference plane Z (3$^{rd}$ reference plane), at least a section of the coil-shaped portion of proximity conductor 110 is wound substantially spirally at least 0.5 turns around the outside of light emitting part 1 or first sealing part 2 in a range defined by reference planes Y and Z, with a closed loop enclosing light emitting part 1 or first sealing part 2 not existing within this range. This structure is described in detail below.

In the present embodiment, as a specific example, the coil-shaped portion of proximity conductor 110 is wound approximately 4 turns around the outside of the end of first sealing part 2 nearer light emitting part 1 so as to be substantially spiral in shape, with the interval between reference planes Y and $X_1$ including approximately two of these turns.

The lead wire used for proximity conductor 110 preferably is 0.1 mm to 1.0 mm in diameter. If less than 0.1 mm in diameter, the lead wire may burn out from the heat that light emitting part 1 generates during operation, while if greater than 1 mm in diameter, on the other hand, manufacturing is hampered along with luminous efficiency being reduced due to the section of the lead wire that cuts across light emitting part 1 blocking a considerable amount of luminous flux.

Furthermore, the pitch interval of proximity conductor 110 preferably is at least 1.5 mm. The danger with a pitch interval of less than 1.5 mm is that a closed loop will form during the life of the lamp due to heat-related changes over time. Here, the "pitch interval" refers to the distance in the longitudinal direction of the bulb from an arbitrary position on the proximity conductor to a position removed one revolution (360° or 1 turn) from the arbitrary position.

The number of turns in proximity conductor 110 is not limited to the 4 turns shown in FIG. 1, and may be any number greater than or equal to 0.5 turns. It is however preferable that adjacent turns do not contact one another, and also that the portion wound around first sealing part 2 be positioned near light emitting part 1.

Lead portion 102, from the viewpoint of activating the initial electrons within discharge space 12 (described below), preferably is disposed so as to contact the outer surface of light emitting part las much as possible. However, because the hottest portion of light emitting part 1 when high-pressure mercury lamp 100 is operated in a roughly horizontal position (longitudinal direction of bulb 14 roughly horizontal) is directly above where the arc between the electrode pair 4 and 5 is generated, giving rise to the possibility of this section melting or being deformed if coming into contact with lead portion 102, lead portion 102 is best not to contact the outer surface of at least this portion of light emitting part 1 (middle part in tube axis direction of light emitting part 1) so as to avoid this occurrence.

(2) Lighting Method for High-Pressure Mercury Lamp 100

A discharge can be initiated with even a fairly low high-voltage pulse if high-pressure mercury lamp 100 is structured as described above and the high-voltage pulse is applied between electrodes 4 and 5 after firstly applying a predetermined high-frequency voltage.

Figure 2:
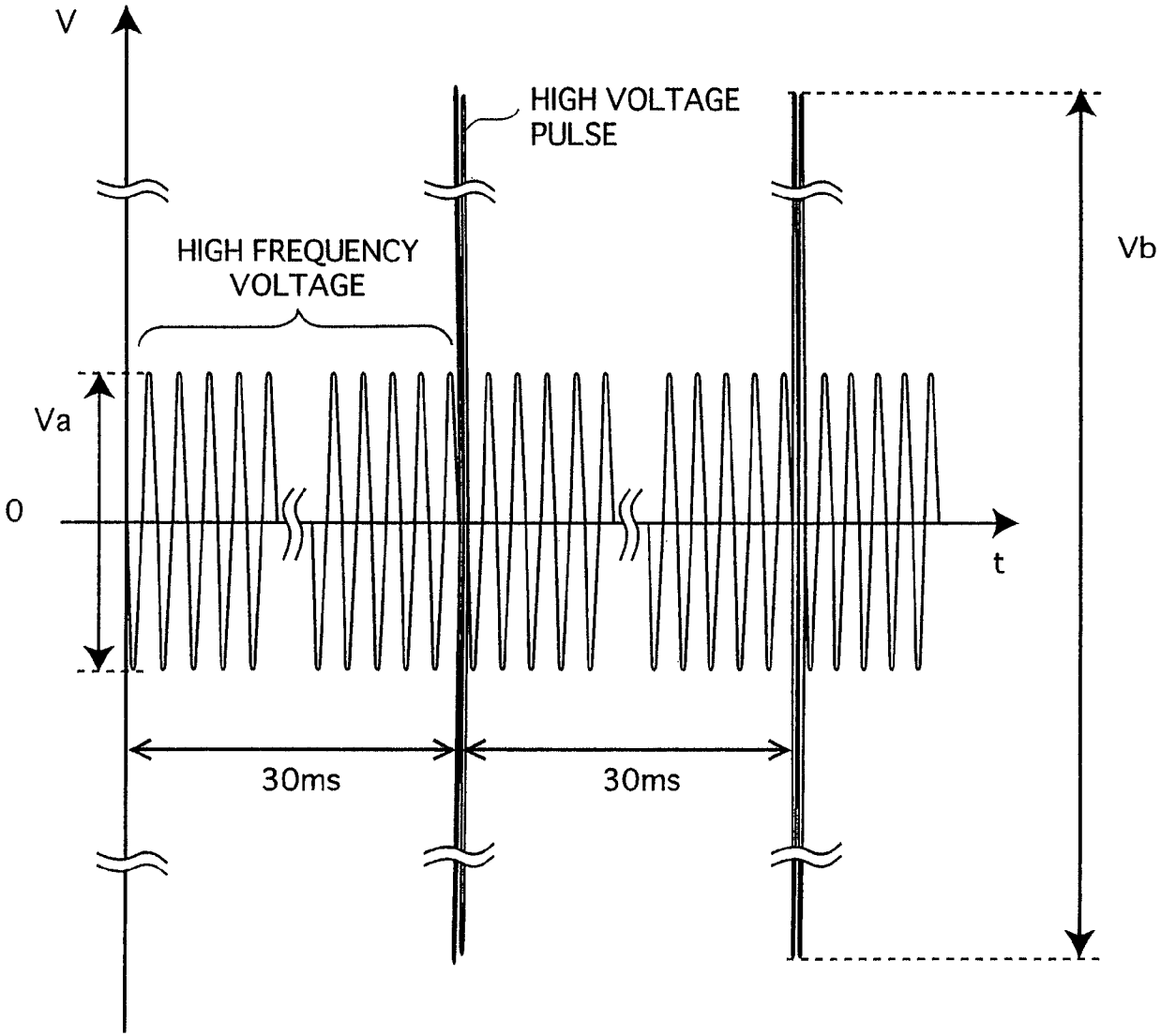
FIG. 2 shows waveforms of a high-frequency voltage and a high-voltage pulse applied to the electrodes when starting the high-pressure mercury lamp.

FIG. 2 is a schematic waveform diagram showing the application of the high-frequency voltage and high-voltage pulse.

The amplitude of the high-frequency voltage is Va, with a high-voltage pulse of amplitude Vb being applied between electrodes 4 and 5 after applying the high-frequency voltage for approximately 30 ms.

Here, the frequency of the high-frequency voltage preferably is 1 kHz to 1 MHz, and amplitude Va preferably is at least 400 V.

Although a discharge is initiated between electrodes 4 and 5 by repeating processing to apply the high-voltage pulse after applying the high-frequency voltage for a predetermined duration (approx. 30 ms in the given example but not limited to this) one or a number of times, the breakdown voltage at this time can be suppressed to a sufficiently low value, in comparison to the breakdown voltage disclosed in Japanese Patent Application Publication No. 2001-43831.

The relation between the frequency and amplitude of the high-frequency voltage and the reduction in breakdown voltage is demonstrated below through tests.

Test 1

Firstly, tests were carried out in relation to the optimal frequency range of the high-frequency voltage in order to effectively reduce the breakdown voltage. The test results are shown in FIG. 3.

In the tests carried out on 150 W high-pressure mercury lamps 100 having the structure shown in FIG. 1, argon was used as the rare gas and fifty each of four types of test lamp were made having enclosed gas pressures respectively of 100 mb, 200 mb, 300 mb and 400 mb, with the breakdown voltage being measured when the discharge was initiated at different frequencies of the high-frequency voltage applied to these test lamps. In the lamps used as 150 W high-pressure mercury lamps 100, the outside diameter and average glass thickness of light emitting part 1 forming discharge space 12 was 10 mm and 2 mm, respectively. The inside diameter ("coil inside diameter") of the coil-shaped portion of proximity conductor 110 was 6 mm. Note that the breakdown voltages in FIG. 3 are the maximum values obtained for the plurality of test lamps under the respective conditions.

Similar to the lamp shown in FIG. 1, there were four turns in proximity conductor 110 around first sealing part 2.

Here, the amplitude of the high-frequency voltage was set to 1 kV.

Note that the enclosed gas pressure in the present tests was set from 100 mb to 400 mb because it is known from previous tests that lamp life characteristics deteriorate when the enclosed gas pressure falls below 100 mb, whereas filling the arc tube to above 400 mb is problematic in terms of manufacturing.

It was demonstrated, as shown in FIG. 3, after having carried out the above tests under these conditions, that by applying a high-frequency voltage of at least 0.5 kHz as a pre-discharge application voltage, the breakdown voltage can be suppressed to 13.0 kV or below even for the test lamps having the highest enclosed gas pressure of 400 mb, this being lower than the conventional 15 kV to 20 kV, and that in a frequency range of 1 kHz to 1 MHz in particular, the breakdown voltage can be suppressed to 8.0 kV or below.

Being able to suppress the breakdown voltage to a low value by setting the frequency of the high-frequency voltage within a predetermined range is attributed to the following principle.

Figure 4:
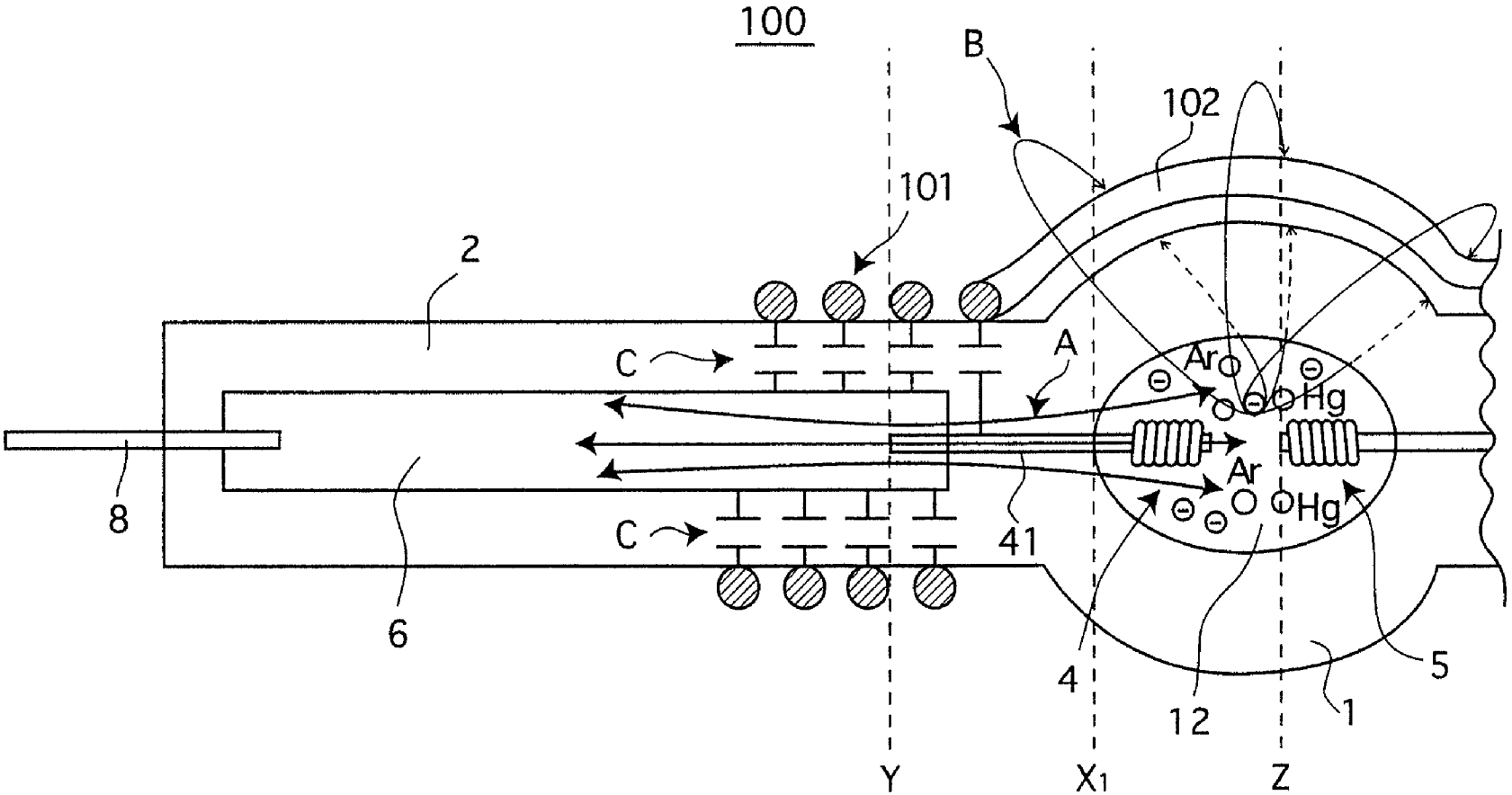
FIG. 4 is schematic view of the increase of initial electrons in the discharge space of the high-pressure mercury lamp when the high-frequency voltage is applied, according to the present invention.

FIG. 4 is a schematic view that illustrates this principle. For the sake of convenience, the coil-shaped portion of proximity conductor 110 is shown in cross-section only.

In FIG. 4:

1) A stray capacitance C exists between proximity conductor 110 and electrode axis 41/molybdenum foil 6, with a high-frequency current flowing to the coil-shaped proximity conductor 110 as a result of the high-frequency voltage applied between conductor 110 and electrode axis 41/molybdenum foil 6.

2) A high-frequency magnetic field A that repeatedly reverses direction in the longitudinal direction of electrode axis 41 is generated as a result of the high-frequency current.

3) A high-frequency electric field is generated by the electromagnetic induction that results from high-frequency magnetic field A, and this acts on the initial electrons within discharge space 12, causing them to oscillate violently.

Naturally, the application of the high-frequency voltage between electrodes 4 and 5 causes a high-frequency electric field to also be generated in the electrode axis direction, and the additional effect of the high-frequency electric field that results from a high-frequency magnetic field B generated by the high-frequency current flowing to the lead portion of proximity conductor 110 causes the motion of the electrons within discharge space 12 to become all the more animated.

4) The animated electrons colliding with rare gas particles (Ar in the given example) and the Ar further colliding with evaporated mercury particles causes electrons to be released from the mercury, thereby increasing the number of initial electrons within discharge space 12.

Being able to initiate a discharge with a very low high-voltage pulse is attributed to the resultant dramatic increase in initial electrons within discharge space 12.

Consequently, if the frequency of the high-frequency voltage is below a given limit, a sufficient high-frequency magnetic field cannot be generated, while if the frequency is too high, on the other hand, the oscillation cycle of the electrons is too fast, which conversely restricts the movement of the electrons and reduces the probability of them colliding with other material, thereby contributing little to any increase in initial electrons.

As shown above, a regular effect is obtained by setting the frequency of the high-frequency voltage to at least 0.5 kHz in order to reduce the breakdown voltage, with a particularly excellent effect being obtained by setting the frequency in a range of 1 kHz to 1 MHz.

Note that even when the number of turns in proximity conductor 110 is varied anywhere from 0.5 to 10 turns, this frequency range remains substantially the same.

Since the principle of the present invention described using FIG. 4 does not suggest that the reduction in breakdown voltage would be adversely affected by there being 11 turns or more, it is ultimately sufficient if proximity conductor 110 has at least 0.5 turns.

Test 2

It follows that if the electrons in discharge space 12 can be made more animated and the breakdown voltage decreased by generating a high-frequency magnetic field of at least a given strength, then there must also be a preferable size range for the high-frequency voltage that contributes to the size of this high-frequency magnetic field.

In view of this, tests were next performed in order to investigate the relation between the size of the high-frequency voltage (amplitude) and the breakdown voltage.

FIG. 5 shows the test results. The breakdown voltages shown in FIG. 5 are the maximum values obtained for the plurality of test lamps under each of the conditions.

Note that in the present tests 150 W high-pressure mercury lamps the same as in the FIG. 3 tests were used, with the enclosed gas pressure set to 400 mb.

The frequency of the high-frequency voltage was set to 100 kHz.

The FIG. 5 test results show that the breakdown voltage can be suppressed to 8.0 kV or below if the amplitude of the high-frequency voltage is at least 400 V.

Consequently, the amplitude of the high-frequency voltage preferably is set to at least 400 V. Even when the number of turns in proximity conductor 110 is varied from 0.5 to 10 turns, these test results remain substantially the same. Thus for the same reasons given above, the number of turns in proximity conductor 110 preferably is at least 0.5 turns.

The relation between the amplitude of the high-frequency voltage and the breakdown voltage shown by the FIG. 5 test results indicates that the breakdown voltage falls with increases in amplitude. The breakdown voltage at 5-kV amplitude is estimated to be no more than 5 kV, while the breakdown voltage at 8-kV amplitude is estimated to be no more than 4 kV. Since the amplitude of the high-frequency voltage is peak-to-peak amplitude, the interelectrode voltage in this case is half of 8 kV, or 4 kV.

In other words, at an amplitude of 8 kV, breakdown is possible using the amplitude of the high-frequency voltage without needing a special high-voltage starting circuit. This is the upper limit for the amplitude of the high-frequency voltage aimed for in the present invention. That is, 8-kV amplitude or less for the high-frequency voltage is sufficient.

Tests similar to tests 1 and 2 performed using 130 W, 200 W and 270 W high-pressure mercury lamps yielded similar test results.

Note that according to the present invention, the inside diameter (cross diameter) of the substantially spirally wound coil-shaped portion of proximity conductor 110 and the distance of lead portion 102 from light emitting part 1 can be arbitrarily set within respective predetermined ranges discussed below. Thus as long as the basic structure of the lamps is the same, the same mechanisms occur in accordance with the above principle for lamps of different sizes and shapes.

Thus the breakdown voltage can be sufficiently reduced irrespective of the size of the high-pressure mercury lamp if the frequency and amplitude of the high-frequency voltage are 1 kHz to 1 MHz and at least 400 V, respectively.

Note that in terms of the above principle of the present invention (i.e. generation of a high-frequency electric field from a high-frequency magnetic field), similar effects are obtained as long as the harmonic component included in the fundamental of the high-frequency voltage satisfies the above conditions (frequency: 1 kHz–1 MHz; amplitude: ≧400 V), even if the fundamental itself does not satisfy these conditions.

(3) Attachment Position of Coil-Shaped Portion & Coil Inside Diameter Etc.

(3-1) Attachment Position of Coil-Shaped Portion & Presence of Closed Loop

Being able to greatly reduced the breakdown voltage according to the above structure of the present invention is due to the fact that, because the section of proximity conductor 110 positioned at the sealing part is wound in a coil around the sealing part, a high-frequency current flows to coil-shaped proximity conductor 110 via stray capacitance C existing between proximity conductor 110 and electrode 41/molybdenum foil 6 when the high-frequency voltage is applied to the electrode pair, thereby generating high-frequency magnetic field A (see FIG. 4). Electromagnetic induction resulting from high-frequency magnetic field A in turn generates a high-frequency electric field, which acts on the initial electrons within discharge space 12 to make them oscillate violently and thus cause an increase in the number of initial electrons.

Needless to say, the coil-shaped portion of proximity conductor 110 preferably is thus as close to reference plane $X_1$ as possible.

In view of this, tests were carried out to establish how far removed the coil-shaped portion could be from reference plane $X_1$ while still obtaining a reduction in breakdown voltage. Using test lamps having an enclosed gas pressure of 400 mb and an identical structure to those in test 1, the breakdown voltage was measured after varying only the position of the coil-shaped portion of proximity conductor 110. Note that the frequency and amplitude of the high-frequency voltage at this time was respectively 100 kHz and 1 kV, with the coil-shaped portion being wound 4 turns in a spiral.

Figure 10:
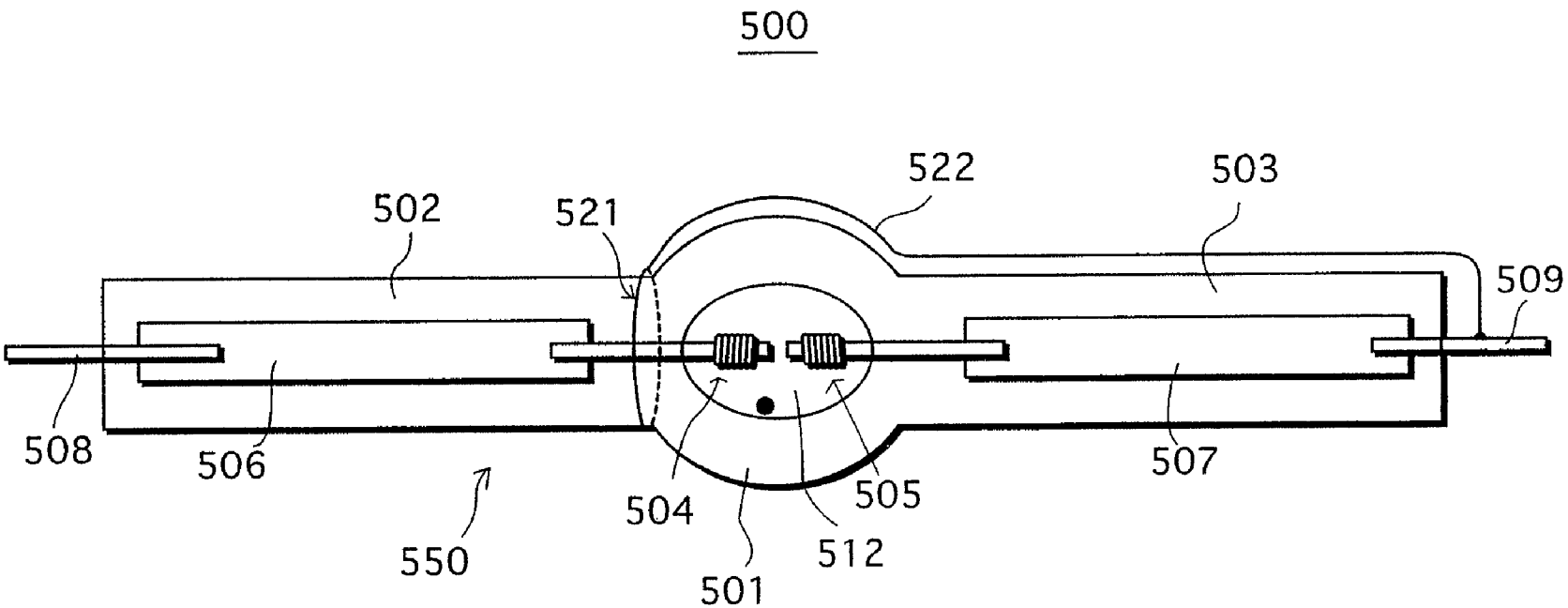
FIG. 10 shows the structure of a conventional high-pressure mercury lamp.

In tests in which coil-shaped portion 101 had a 0.5 turn whose origin and terminus was respectively 18 mm and 20 mm from reference plane $X_1$, with a closed loop enclosing the sealing part not existing in the coil-shaped portion, the breakdown voltage was also 8.0 kV. A satisfactory result is thus obtained in comparison to the prior art shown in FIG. 10. However, when even one closed loop was formed in coil-shaped portion 101 due, for example, to the pitch interval being narrowed and adjacent turns contacting one another, the decrease in breakdown voltage was not as great as expected. In actual tests in which two adjacent turns positioned 21 mm from reference plane $X_1$ in a 4-turn coil-shaped portion having an origin 15 mm from reference plane $X_1$ were made to contact one another, the breakdown voltage was 12.0 kV.

This is attributed to the fact that when generating a high-frequency magnetic field, the existence of a closed loop in the conductor results in a magnetic field occurring in the conductor in a direction that eliminates the high-frequency magnetic field. Thus, when a closed loop does not exist in coil-shaped portion 101, a desirable reduction in breakdown voltage is obtained if the coil-shaped portion of proximity conductor 110 has at least 0.5 turns in a range from reference plane $X_1$ up until a position 20 mm from reference plane $X_1$ in the tube-axis direction.

Note that while the distance from the end of coil-shaped portion 101 to either external lead wire 8 leading out from first sealing part 2 or a conductor connected to external lead wire 8 decreases as the number of turns increases with the coil-shaped portion of proximity conductor 110 in the furthest position from reference plane $X_1$ (20 mm), the fact that lighting errors arise if this distance is too short due to a discharge occurring between the two ends when the high-voltage pulse is applied dictates that this distance be a minimum of 5 mm, and preferably at least 10 mm.

The effect the high-frequency magnetic field generated in coil-shaped portion 101 by the application of the high-frequency voltage has on the discharge space gradually increases as the position at which coil-shaped portion 101 is provided around first sealing part 2 moves closer to reference plane $X_1$, with a breakdown voltage of 6.0 kV being achieved when a 0.5 turn is included within the interval between reference plane $X_1$ and reference plane Y distant 5 mm from reference plane $X_1$ (see FIG. 1).

Coil-shaped portion 101 is provided as close to second sealing part 3 as reference plane Z passing through the tip of electrode 5. The potential of the corresponding electrode 5 and molybdenum foil 7 remains the same when the coil-shaped portion is provided even closer to second sealing part 3, making this configuration pointless since a high-frequency magnetic field is not generated in the additional section. In fact, no problems were encountered in terms of the effects, even when coil-shaped portion 101 having 0.5 turns was situated in the interval from reference plane $X_1$ to a reference plane Z positioned approximately 5 mm from reference plane $X_1$ in the direction of second sealing part 3. Forming a high-frequency magnetic field with electrode 4 is possible even in this position.

Note that a closed loop was experimentally formed at this time by having one set of adjacent turns in the coil-shaped portion come into contact with one another. While the reduction in breakdown voltage was not greatly affected in the case of the closed loop being formed at a position removed more than 5 mm from reference plane $X_1$ (i.e. position lying on the outside of reference plane Y), a sufficient reduction in breakdown voltage was not obtained (11.5 kV) when the closed loop was positioned between reference plane Y and reference plane Z.

In other words, while a closed loop preferably is not formed in coil-shaped portion 101 in terms of effectively forming the high-frequency magnetic field as described above, it is thought that because the effect of the high-frequency magnetic field formed by coil-shaped portion 101 increases as coil-shaped portion 101 is positioned closer to discharge space 12, a sufficient reduction in breakdown voltage will be achieved even if there is a closed loop. It is however thought that discharge space 12 is subject to the effect of a magnetic field generated in a direction that eliminates the high-frequency magnetic field when a closed loop is formed in a section of coil-shaped portion 101 within the range defined by the two reference planes Y and Z, inhibiting the reduction in breakdown voltage. This boundary is marked by reference plane Y removed 5 mm from reference plane $X_1$.

Put another way, it is possible for a sufficient high-frequency magnetic field to be exerted on discharge space 12 as long as spiral coil-shaped portion 101 having at least 0.5 turns exists within the range defined by reference planes Y and Z, thus allowing for the desired reduction in breakdown voltage to be obtained even if a closed loop is formed outside of this range, for example.

To summarize the above discussion, (a) in the case of a closed loop not being formed in coil-shaped portion 101, it is sufficient if a spiral portion having at least 0.5 turns is formed in a range from reference plane $X_1$ to a position distant 20 mm from reference plane $X_1$ in the direction of first sealing part 2, and (b) even if a closed loop is formed in a section of coil-shaped portion 101, for example, an excellent reduction in breakdown voltage is obtained as long as the spiral part has at least 0.5 turns and the closed loop is not included in the interval between reference planes Y and Z.

The "closed loop" discussed here refers to a closed loop that encloses light emitting part 1 or first sealing part 2, given that this closed loop results in a current that interferes with the generation of the high-frequency magnetic field by coil-shaped portion 101. A closed loop not enclosing light emitting part 1 or first sealing part 2 does not adversely affect the present invention whatever position it is formed.

(3-2) Diameter Range of Coil-Shaped Portion

The inside diameter of coil-shaped portion 101 in proximity conductor 110 can only be as small as the outside diameter of sealing parts 2 and 3, given the restrictions imposed by the structure of high-pressure mercury lamp 100.

In view of this, tests were next performed in relation to the maximum inside diameter permitted of coil-shaped portion 101.

Tests to measure the breakdown voltage were performed using high-pressure mercury lamp 100 shown in FIG. 1, while gradually enlarging the coil inside diameter with coil-shaped portion 101 having 0.5 turns provided substantially concentrically with the lamp tube axis on the first sealing part side of the lamp at a position 20 mm from reference plane $X_1$. Tests were repeated while varying the frequency appropriately from 1.0 kHz to 1.0 MHz, with the enclosed gas pressure set at 400 mb and the amplitude of the high-frequency voltage fixed at 1 kV.

In these tests it was possible to suppress the breakdown voltage to around 8 kV even when the coil inside diameter was enlarged to around 15 mm.

Generally with a coil having few turns, the strength of the magnetic field generated in a central vicinity of the coil is in inverse proportion to the coil radius. According to the above principle of the present invention, a strong high-frequency electric field is generated within the discharge space due to a resonance circuit being formed between the inductance of coil-shaped portion 101 and stray capacitance C existing between the coil and electrode axis 41/molybdenum foil 6 (see FIG. 4), thereby enabling the effect of reduced breakdown voltage to be obtained. Moreover, it is thought that a plurality of resonance circuits is formed and that they interact in complex ways.

While stray capacitance C changes in size and the resonance point fluctuates with increases in the coil inside diameter, as long as there exists a resonance having a frequency within an appropriate range, a high-frequency electric field can be generated to effectively lower the breakdown voltage. However, it is thought that once the coil inside diameter exceeds a certain size, not only is the strength of the magnetic field acting on the initial electrons in discharge space 12 reduced, but the capacitance between coil-shaped portion 101 and molybdenum foil 6/electrode 41 drops with increases in the coil inside diameter, obstructing the current flow to coil-shaped portion 101, all of which acts collectively to eliminate the effect of reduced breakdown voltage.

Note that while in the tests the desired effect was obtained with a maximum coil inside diameter of 15 mm, the starting operation tended to be slightly unstable, making it preferable for coil-shaped portion 101 to have a maximum coil inside diameter of no more than 10 mm in order to obtain the effects with a stable starting operation.

Given the importance of the high-frequency magnetic field generated by coil-shaped portion 101 acting on the discharge space within the light emitting part, the diameter of coil-shaped portion 101 when enlarged need only be as large as the maximum outside diameter of the light emitting part (10 mm in the present embodiment), with the need to provide a larger diameter than this being unlikely.

(3-3) Distance Between Lead Wire & Light Emitting Part

Since the combined action of magnetic fields A and B is thought to produce the effect of the present invention as described above using FIG. 4, the lead portion of proximity conductor 110 preferably is brought as close to discharge space 12 as possible by having lead portion 102 approach or contact the outer surface of light emitting part 1. Tests confirmed that particularly excellent effects are obtained when the shortest distance between lead portion 102 of the proximity conductor and the inner surface of light emitting part 1 in an area defined by reference plane $X_1$ and a reference plane $X_2$ ($4^{th}$ reference plane) that includes the end of discharge space 12 positioned at the base portion of electrode 5 nearer second sealing part 3 is no more than 10 mm.

(4) Lighting Device

Figure 6:
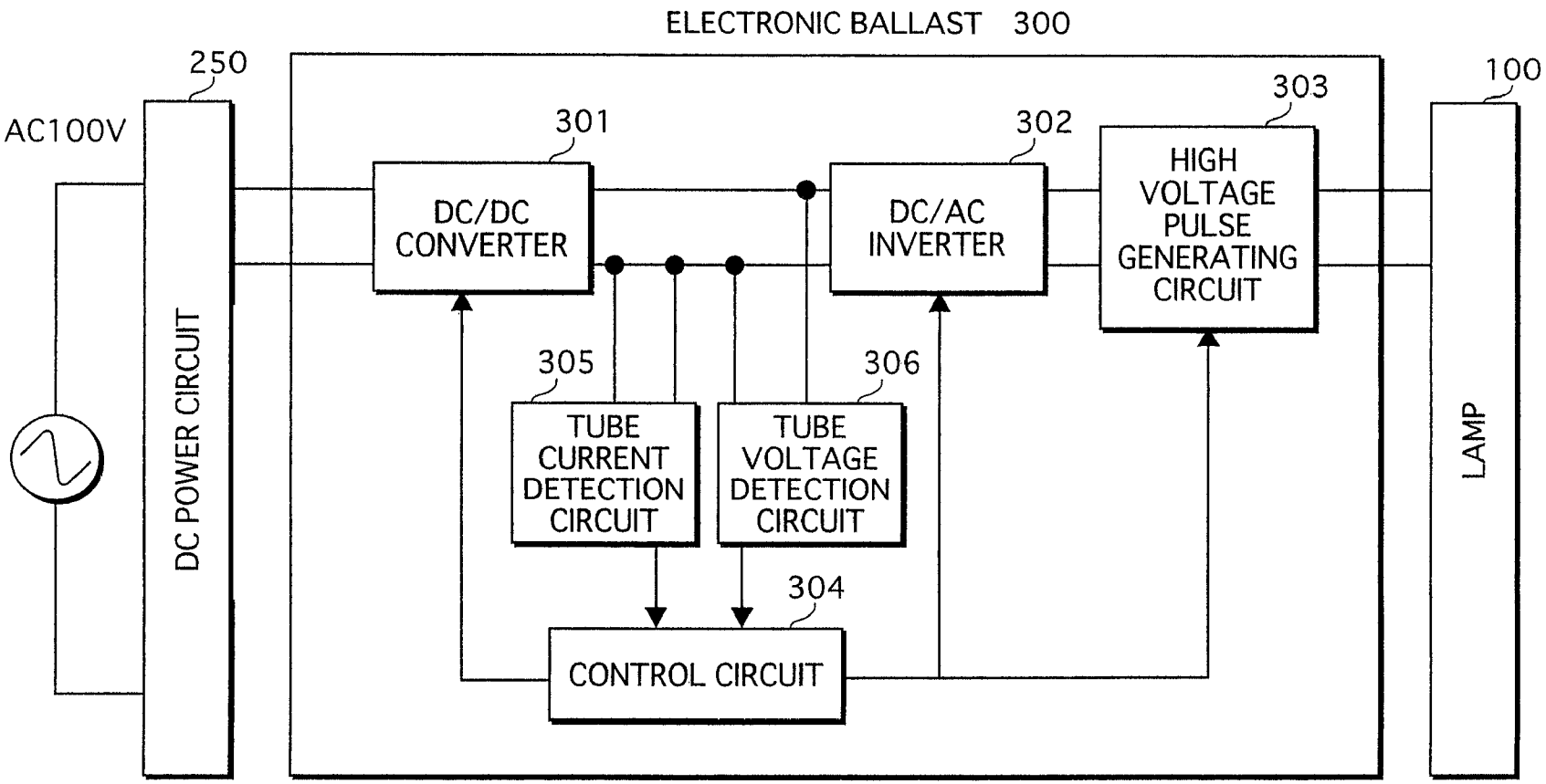
FIG. 6 is a block diagram showing the structure of a lighting device pertaining to the present invention.

FIG. 6 is a block diagram showing the structure of a lighting device for lighting high-pressure mercury lamp 100.

As shown in the diagram, the lighting device includes a DC power circuit 250 and an electronic ballast 300, which is itself structured from a DC/DC converter 301, a DC/AC inverter 302, a high-voltage pulse generating circuit 303, a control circuit 304, a tube-current detection circuit 305, and a tube-voltage detection circuit 306.

DC power circuit 250 generates a DC voltage using a household 100 V AC power supply, and supplies the generated voltage to electronic ballast 300. DC/DC converter 301 in electronic ballast 300 converts the DC voltage supplied from DC power circuit 250 to a predetermined DC voltage and supplies the converted voltage to DC/AC inverter 302.

DC/AC inverter 302 generates a rectangular AC current of a predetermined frequency and applies the generated current to high-pressure mercury lamp 100. High-voltage pulse generating circuit 303, which is necessary for initiating the discharge in lamp 100, includes a transformer, for example, and initiates the discharge by applying a high-voltage pulse generated in circuit 303 to lamp 100.

Tube-current detection circuit 305 and tube-voltage detection circuit 306, on the other hand, are both connected to the input side of DC/AC inverter 302, and function respectively to detect the lamp current and lamp voltage of high-pressure mercury lamp 100 indirectly, and output detection signals to control circuit 304.

Control circuit 304 controls DC/DC converter 301 and DC/AC inverter 302 based on these detection signals and computer programs stored in internal memory, so as to light high-pressure mercury lamp 100 using the above lighting method.

Figure 7:
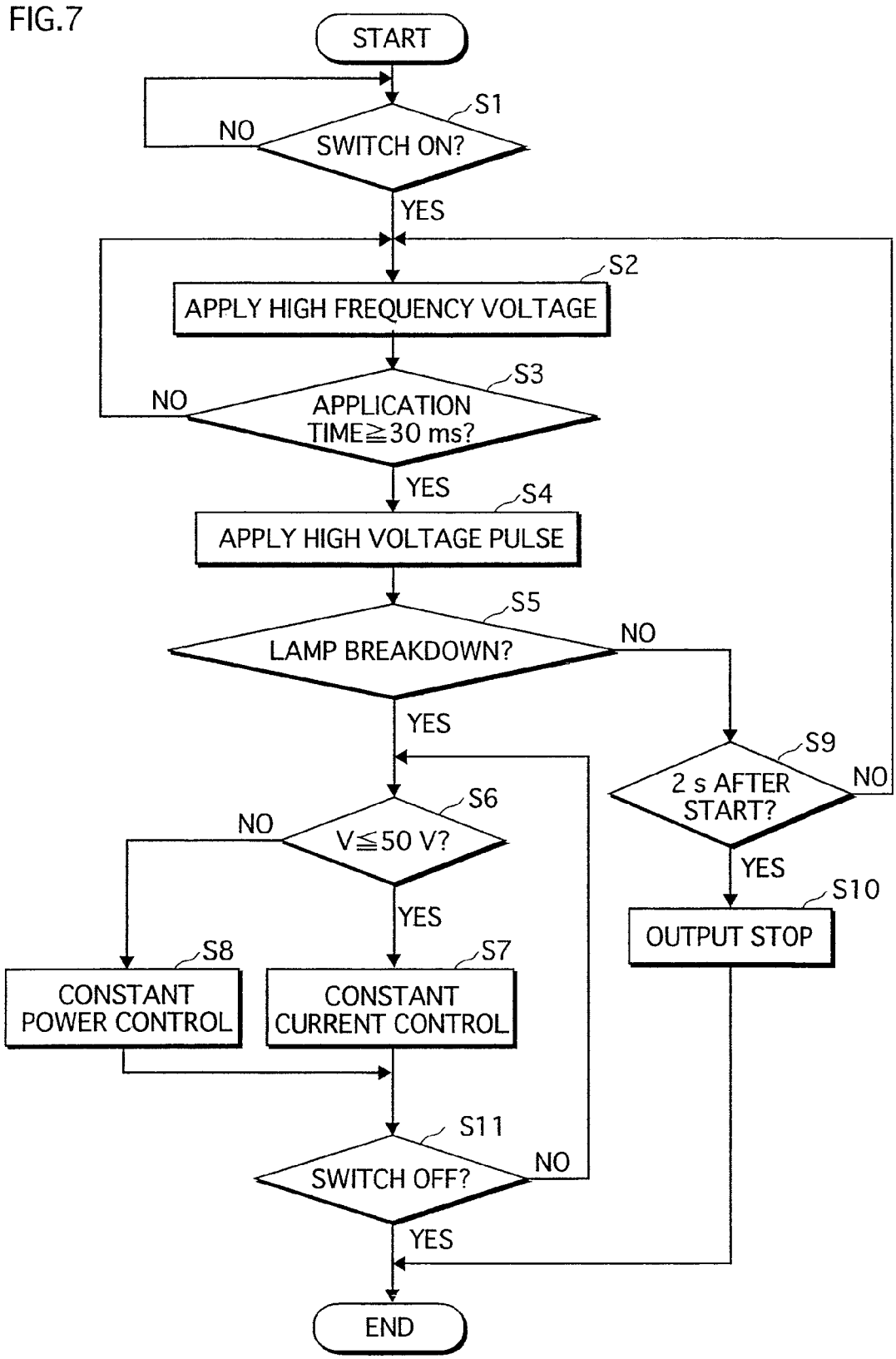
FIG. 7 is a flowchart showing lighting controls executed by a control circuit in the lighting device.

FIG. 7 is a flowchart showing a lighting control performed on a 150 W high-pressure mercury lamp 100 by control circuit 304.

When a light switch (not depicted) is turned ON (step S1: YES), control circuit 304 controls DC/DC converter 301 and DC/AC inverter 302 to generate a predetermined high-frequency voltage that satisfies the above conditions, and the voltage is applied to high-pressure mercury lamp 100 (step S2). When the voltage has been applied for 30 ms, a high-voltage pulse of 8 kV, for example, is generated by high-voltage pulse generating circuit 303 and applied to high-pressure mercury lamp 100 (step S3: YES, step S4).

Control circuit 304 then judges whether breakdown has occurred in high-pressure mercury lamp 100 (step S5). Since the lamp voltage drops below a given value once breakdown has occurred and the discharge initiated, control circuit 304 can judge whether breakdown has occurred by monitoring the detection signals from tube-voltage detection circuit 306.

If breakdown has not occurred in high-pressure mercury lamp 100 (step S5: NO), control circuit 304 moves to step S9 and judges whether two seconds has elapsed since the start of the lighting controls, and if not yet elapsed, control circuit 304 returns again to step S2 and repeats the subsequent steps. If judged at step S5 that breakdown has occurred, control circuit 304 moves to step S6 and judges whether the lamp voltage is 50 V or less.

If the lamp voltage is 50 V or less (step S6: YES), control circuit 304 moves to the constant current control of step S7. This constant current control involves controlling DC/DC converter 301 based on the detection signals from tube-current detection circuit 305 so as to establish a regular lamp current of 3 A.

If the lamp voltage exceeds 50 V (step S6: NO), control circuit 304 moves to the constant voltage control of step S8. This constant voltage control is executed by using control circuit 304 to monitor lamp current and lamp voltage based on the detection signals from tube-current detection circuit 305 and tube-voltage detection circuit 306, and perform feedback controls on the lamp current values outputted from DC/DC converter 301, for example, so that lamp power (lamp current×lamp voltage) is always 150 W. Steps S6 to S8 are constantly repeated during lamp operation (step S11: NO) and the processing ended when the light switch is turned OFF (step S11: YES). Note that during the constant current and voltage controls, the voltage applied to high-pressure mercury lamp 100 is an AC voltage of approximately 170 Hz.

On the other hand, if judged in step S9 that two seconds has elapsed since the start of the lighting controls, control circuit 304 judges that there is something wrong with high-pressure mercury lamp 100, moves to step S10, and ends the lighting controls after terminating output to the lamp.

(5) Field of Use of High-Pressure Mercury Lamp 100

1) Lamp Unit & LCD Projector

High-pressure mercury lamp 100 combines high brightness with compactness, and is thus often employed as a light source for LCD (liquid crystal display) projectors and the like, in which case it is usually shipped as a lamp unit together with a reflective mirror.

Figure 8:
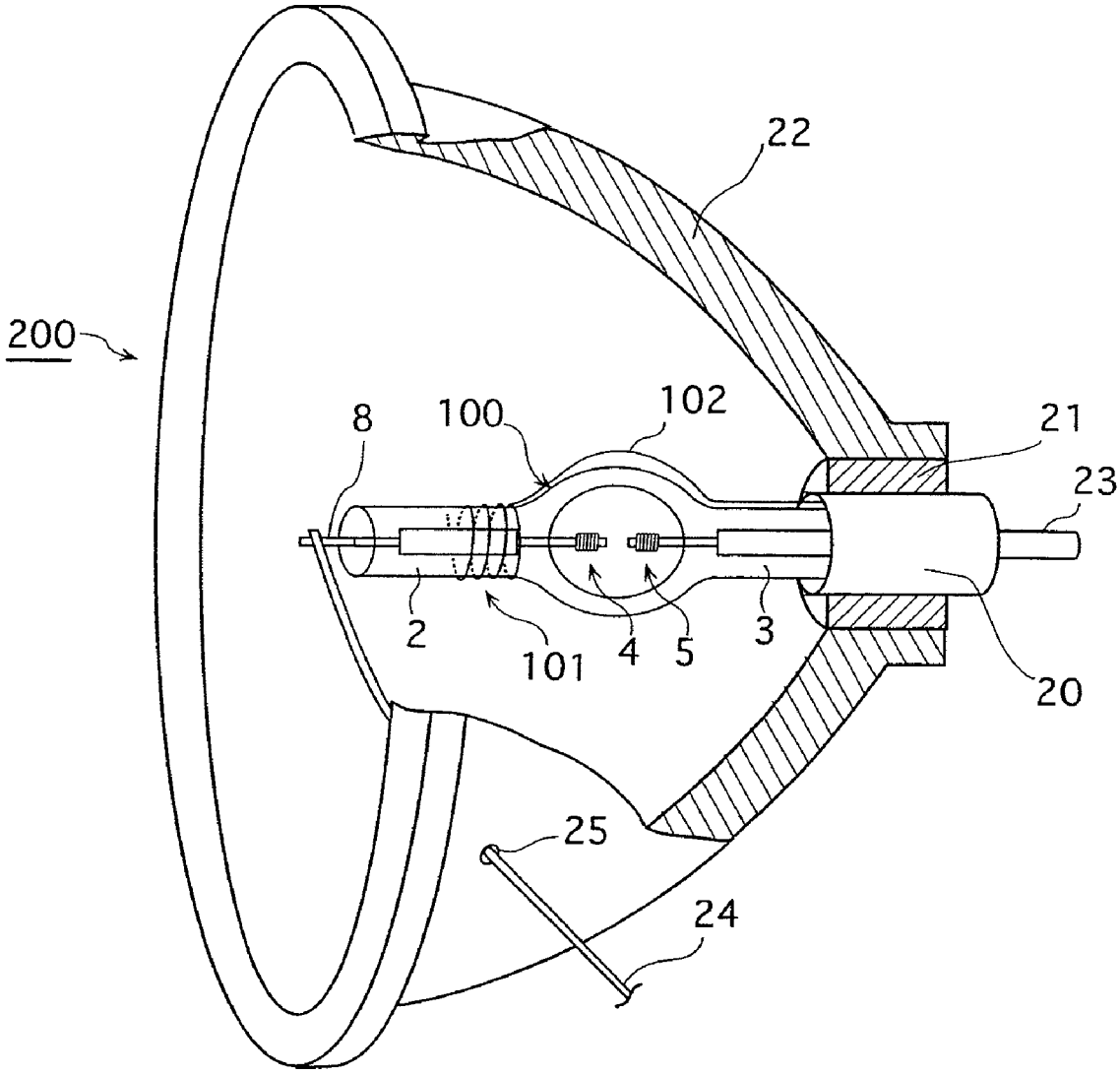
FIG. 8 is a partial cutaway perspective view showing the structure of a lamp unit pertaining to the present invention.

FIG. 8 is a partial cutaway perspective view showing the structure of a lamp unit 200 that incorporates high-pressure mercury lamp 100. As shown in the diagram, a base 20 in lamp unit 200 is mounted to the end of sealing part 3, and fixed via spacer 21 to a reflective mirror 22 whose inner surface forms a concave mirror, using a bonding agent or the like. To improve the light collection efficiency of reflective mirror 22, base 20 is attached so that the position of the discharge arc between electrodes 4 and 5 is adjusted to substantially coincide with the light axis of reflective mirror 22.

Power is supplied to external lead wires 8 and 9 of high-pressure mercury lamp 100 (see FIG. 1) via a terminal 23 and a lead wire 24, which is drawn out through a thru hole 25 provided in reflective mirror 22.

Proximity conductor 110 is wound around first sealing part 2, which is at the opposite end to second sealing part 3 having base 20 fixed thereto.

Figure 9:
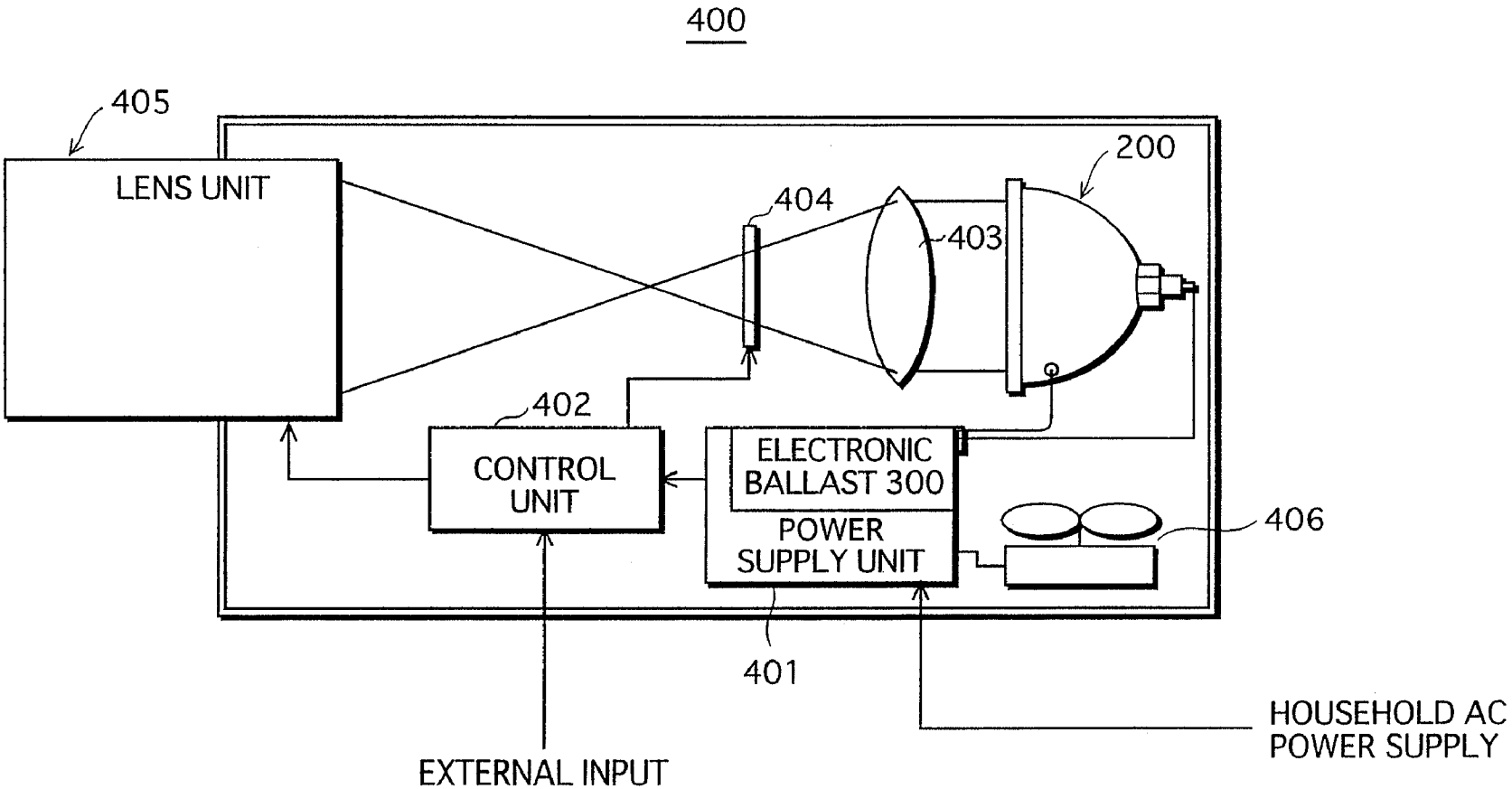
FIG. 9 shows the structure of an LCD projector that employs a high-pressure discharge lamp device pertaining to the present invention.

FIG. 9 is a schematic view showing the structure of an LCD projector 400 that employs lamp unit 200 and the lighting device shown in FIG. 6.

As shown in the diagram, LCD projector 400 includes a power supply unit 401 that has electronic ballast 300, a control unit 402, a collective lens 403, a transmissive color LCD display board 404, a lens unit 405 that integrates a drive motor, and a cooling fan device 406.

Power supply unit 401 converts a household 100V AV power supply to a predetermined DC voltage, and supplies the DC voltage to electronic ballast 300 and control unit 402 etc. Control unit 402 drives color LCD display board 404 to have color images displayed based on image signals inputted from an external source. Control unit 402 also controls the drive motor in lens unit 405 to have focusing, zooming and other operations executed.

The light source radiated from lamp unit 200 is collected by collective lens 403, passes through color LCD display board 404 disposed on the light path, and has images formed by LCD display board 404 projected onto a screen (not depicted) via lens unit 405.

Given the technical object of further miniaturization, weight reduction and cost savings with regard to LCD projectors, which have seen a remarkable spread to households in recent years, LCD projector 400 is able to contribute amply to achieving this technical object by using a light source device (hereinafter "high-pressure discharge lamp device") that includes a high-pressure mercury lamp and a lighting device pertaining to the present invention.

Also, decreasing the high-voltage pulse generated by the lighting device also allows for a reduction in electrical noise arising when this pulse is generated, and for any adverse affects on the electronic circuitry in control unit 402 to be eliminated. The degree of freedom with respect to component placement within the LCD projector is thus increased, making further miniaturization possible.

A high-pressure discharge lamp device pertaining to the present invention can, needless to say, also be applied in projection-type image display devices other than LCD projectors.

2) Headlight Device

A high-pressure discharge lamp device pertaining to the present invention may be used in headlight devices for cars and the like. While the headlight structure itself is well known and not depicted here, using high-pressure mercury lamp 100 as the light source and providing electronic ballast 300 as the lighting device of the headlight device makes it possible to reduce the space required for housing components and also battery consumption.

Significant effects are obtained by the use in a headlight device of a high-pressure discharge lamp device such as the present invention that is compact, light and low noise, particularly in today's climate in which cars are being loaded with lots of electronic circuitry following recent moves toward high technologization and multifunctionalization, while car manufacturers are seeking at the same time to miniaturize electronic components and reduce the housing space for engines and components in order to make the inside of cars as roomy as possible.

Modifications

The content of the present invention is, needless to say, not limited to the preferred embodiment, with it being possible to arrive at the following modifications.

(1) Shape of Wound Portion in Proximity Conductor 110

Proximity conductor 110 need only be substantially spiral, and is not necessarily required to be a circular configuration extending along first sealing part 2 when viewed in the longitudinal direction of the bulb. Proximity conductor 110 may have an angular configuration such as a triangle or a square.

(2) Material Used for Proximity Conductor 110

In the preferred embodiment, an iron chromium alloy is used as the material for proximity conductor 110. In addition to being heat resistant, this alloy does not readily oxidize even at high temperatures and is relatively cheap. However, other materials such as platinum and carbon, for example, can be used as long as the material is a conductor that does not readily oxidize.

(3) Application of High-Voltage Pulse

In the preferred embodiment, the discharge is initiated by applying a high-voltage pulse. However, the high-voltage pulse need not be applied if the lamp discharge can be initiated using only the high-frequency voltage. In this case, the structure of the lighting circuitry is simplified, enabling manufacturing costs to be further decreased.

(4) Application in Other Lamps

While the preferred embodiment is described above in relation to a high-pressure mercury lamp, the present invention can be applied in other types of high-pressure discharge lamp such as xenon lamps, as long as the lighting principle is the same.

A reduction in breakdown voltage is also obtained with lamps other than those having a so-called foil-seal construction that use a quartz bulb and seal the bulb with a metal foil (molybdenum foil), such as metal halide lamps and high-pressure natrium lamps employing a transmissive ceramic tube as the discharge vessel, as long as a proximity conductor having at least 0.5 turns is formed within the above-stated range, and the frequency and amplitude of the applied high-frequency voltage are 1 kHz to 1 MHz and at least 400 V, respectively.

Industrial Applicability

A high-pressure mercury lamp pertaining to the present invention is effective in the miniaturization, weight reduction and cost savings of lighting devices because of being able to suppress the breakdown voltage to a low value.

The invention claimed is:

1. A high-pressure discharge lamp comprising:

a bulb that includes a light emitting part having an electrode pair disposed and a discharge space formed therein, and a first sealing part and a second sealing part provided at different ends of the light emitting part; and a proximity conductor formed from a lead wire, a section of the lead wire being wound around an outer circumference of at least one of the first sealing part and a section of the light emitting part to form a wound portion, and a remaining section of the lead wire forming a lead portion that extends from the wound portion across the light emitting part in proximity to or contacting with an outer surface of the light emitting part, to a side of the discharge lamp on which the second sealing part is disposed, wherein the lead portion is electrically connected to the electrode, of the pair, positioned nearer the second sealing part, and the wound portion and the lead portion are without a closed loop and the wound portion has at least a section wound substantially spirally at least 0.5 turns in a range from a $2^{nd}$ reference plane to a $3^{rd}$ reference plane that are parallel to a $1^{st}$ reference plane lying orthogonal to a bulb longitudinal direction and including an end of the discharge space positioned at a base portion of the electrode nearer the first sealing part, the $2^{nd}$ reference plane being distant 20 mm from the $1^{st}$ reference plane along the first sealing part, and the $3^{rd}$ reference plane passing through a tip of the electrode nearer the second sealing part.

2. The high-pressure discharge lamp of claim 1, wherein a shortest distance from the lead portion to the inner surface of the light emitting part is 10 mm or less in a range defined by the $1^{st}$ reference plane and a $4^{th}$ reference plane parallel to the $1^{st}$ reference plane and including an end of the discharge space positioned at a base portion of the electrode nearer the second sealing part.

3. The high-pressure discharge lamp of claim 1 wherein in a range defined by the $2^{nd}$ and $3^{rd}$ reference planes, a pitch interval of the substantially spirally wound portion of the proximity conductor is at least 1.5 mm.

4. A lighting method for a high-pressure discharge lamp as in claim 1, according to which a discharge of the high-pressure discharge lamp is initiated after applying a high-frequency voltage to the electrode pair.

5. The lighting method lamp of claim 4, wherein a frequency of the high-frequency voltage is in a range of 1 kHz to 1 MHz.

6. The lighting method lamp of claim 4, wherein an amplitude of the high frequency voltage is at least 400 V.

7. A lighting device for lighting a high-pressure discharge lamp as in claim 1 comprising a voltage applying unit operable to apply a high-frequency voltage to the electrode pair.

8. The lighting method lamp of claim 7, wherein a frequency of the high-frequency voltage is in a range of 1 kHz to 1 MHz.

9. The lighting method lamp of claim 7, wherein an amplitude of the high frequency voltage is at least 400 V.

10. A high-pressure discharge lamp device comprising a high-pressure discharge lamp as in claim 1 and a lighting device as in claim 7 for lighting the high-pressure discharge lamp.

11. A lamp unit in which a high-pressure discharge lamp as in claim 1 is incorporated within a concave reflective mirror.

12. An image display device using a high-pressure discharge lamp device as in claim 10.

13. A headlight device using a high-pressure discharge lamp device as in claim 10.

14. A high pressure discharge lamp comprising:

a bulb that includes a light emitting part having an electrode pair disposed and a discharge space formed therein, and a first sealing part and a second sealing part provided at different ends of the light emitting part; and a proximity conductor formed from a lead wire, a section of the lead wire being wound around an outer circumference of at least one of the first sealing part and a section of the light emitting part to form a wound portion, and a remaining section of the lead wire forming a lead portion that extends from the wound portion nearer the second sealing part across the light emitting part in proximity to or contacting with an outer surface of the light emitting part, to a side of the discharge lamp on which the second sealing part is disposed, wherein the lead portion is electrically connected to the electrode, of the pair, positioned nearer the second sealing part; and the wound portion and the lead wire are without a closed loop and the wound portion has at least a section wound substantially spirally at least 0.5 turns in a range from a $2^{nd}$ reference plane to a $3^{rd}$ reference plane that are parallel to a $1^{st}$ reference plane lying orthogonal to a bulb longitudinal direction and including an end of the discharge space positioned at a base portion of the electrode nearer the first sealing part, the $2^{nd}$ reference plane being distant 20 mm from the $1^{St}$ reference plane along the first sealing part, and the $3^{rd}$ reference plane passing through a tip of the electrode nearer the second sealing part.

* * * * *